US005577456A

United States Patent [19]

Kobayashi et al.

[11] Patent Number: 5,577,456

[45] Date of Patent: Nov. 26, 1996

[54] SUBMERSIBLE PROPULSION UNIT

[75] Inventors: Kiyonobu Kobayashi; Yasunari Okamoto, both of Hamamatsu, Japan

[73] Assignee: Sanshin Kogyo Kabushiki Kaisha, Hamamatsu, Japan

[21] Appl. No.: 342,346

[22] Filed: Nov. 18, 1994

[30] Foreign Application Priority Data

Nov. 24, 1993 [JP] Japan ..... 5-315824
Nov. 24, 1993 [JP] Japan ..... 5-315825

[51] Int. Cl.[6] ..... B63B 21/56

[52] U.S. Cl. ..... 114/315; 114/242; 440/88; 440/38

[58] Field of Search ..... 440/88, 38, 113, 440/6; 114/315, 242, 270, 337, 339, 211; 128/201.11

[56] References Cited

U.S. PATENT DOCUMENTS

| | | | |
|---|---|---|---|
| 3,648,643 | 3/1972 | Murray | 114/270 |
| 3,826,220 | 7/1974 | Jacobson | 114/270 |
| 3,890,920 | 6/1975 | Buelk | 114/315 |
| 4,160,425 | 7/1979 | Curtis | 440/88 |
| 4,568,293 | 2/1986 | Yazaki | 114/270 |
| 4,611,551 | 9/1986 | Ferguson et al. | 114/339 |
| 4,635,582 | 1/1987 | Nishida | 114/270 |
| 5,117,817 | 6/1992 | Lin | 128/201.11 |
| 5,388,543 | 2/1995 | Ditchfield | 114/315 |

*Primary Examiner*—Edwin L. Swinehart
*Attorney, Agent, or Firm*—Knobbe, Martens, Olson & Bear

[57] ABSTRACT

A small submersible propulsion unit for use in water sports such as snorkeling or skindiving. The propulsion unit includes an internal combustion engine and a propulsion device driven by the engine. Air is supplied to the engine for its combustion through an air box that is formed above the engine and which draws air through a snorkel device having a float operated valve for preventing the ingestion of water if the propulsion unit becomes submerged to a large extent. In addition, certain accessories for the engine are disposed in the air box and are accessible through an access opening in the air box for servicing.

7 Claims, 6 Drawing Sheets

SUBMERSIBLE PROPULSION UNIT

BACKGROUND OF THE INVENTION

This invention relates to a submersible power unit and more particularly to an improved small propulsion unit that can be employed by swimmers or for snorkeling.

There has been proposed a very small type of compact water propulsion unit that is designed for use primarily for snorkelers or swimmers. This propulsion unit is comprised generally of a frame assembly that mounts an internal combustion engine and a propulsion device which is driven by the engine. With this type of arrangement, the engine is operated at least in a partially submerged condition and the induction system for the engine includes an air box that draws air through an air inlet device that extends above the water level. This type of unit has relatively low power but can be employed for the purposes as aforenoted.

Obviously, this type of unit is designed to be operated only at relatively shallow depths and hence the air inlet device only extends a small distance above the water level. However, there are many instances when the unit may be submerged to a level greater than the air inlet device can operate and this can cause the ingestion of water.

It is, therefore, a principal object of this invention to provide an improved air inlet device for a submersible power unit.

It is a further object of this invention to provide an improved air inlet device for a submersible power unit that will ensure against the ingestion of water if the unit is submerged to a level greater than it is designed for.

In order to permit the engine to operate in a submerged or partially submerged state, it is necessary that a number of the auxiliaries for the engine be protected from the water. However, these components also are such that should be easily accessible. Therefore, the components are generally provided within a watertight environment with one or more access plates that can be removed to permit servicing of the components. Examples of such components are the battery, spark plugs, and other like components of the engine that require frequent servicing.

However, the aforenoted types of constructions and particularly those employing closure plates that are held on by screws give rise to substantial sealing problems.

It is, therefore, a still further object of this invention to provide an improved submersible power unit wherein certain components to be serviced are contained within an air chamber and can be easily accessed through a large closure that is well sealed to the air chamber.

SUMMARY OF THE INVENTION

This invention is adapted to be embodied in a personal submersible propulsion unit that is comprised of a frame assembly, an internal combustion engine having an induction system carried by the frame assembly for at least partial submersion in a body of water and a propulsion device carried by the frame assembly and driven by the engine for propelling the frame assembly through a body of water.

In accordance with a first feature of the invention, the induction system includes an air inlet device that extends above the level of water in which the propulsion unit is operated and which has means responsive to the level of submersion of the propulsion device for controlling the air inlet device.

In accordance with another feature of the invention, an air chamber is provided for containing a body of air and certain accessories for the engine are positioned in this air chamber. The air chamber is accessible through a screw-type closure so that the components can be easily serviced through the opening closed by this closure.

DETAILED DESCRIPTION OF THE PREFERRED EMBODIMENT OF THE INVENTION

Figure 1:
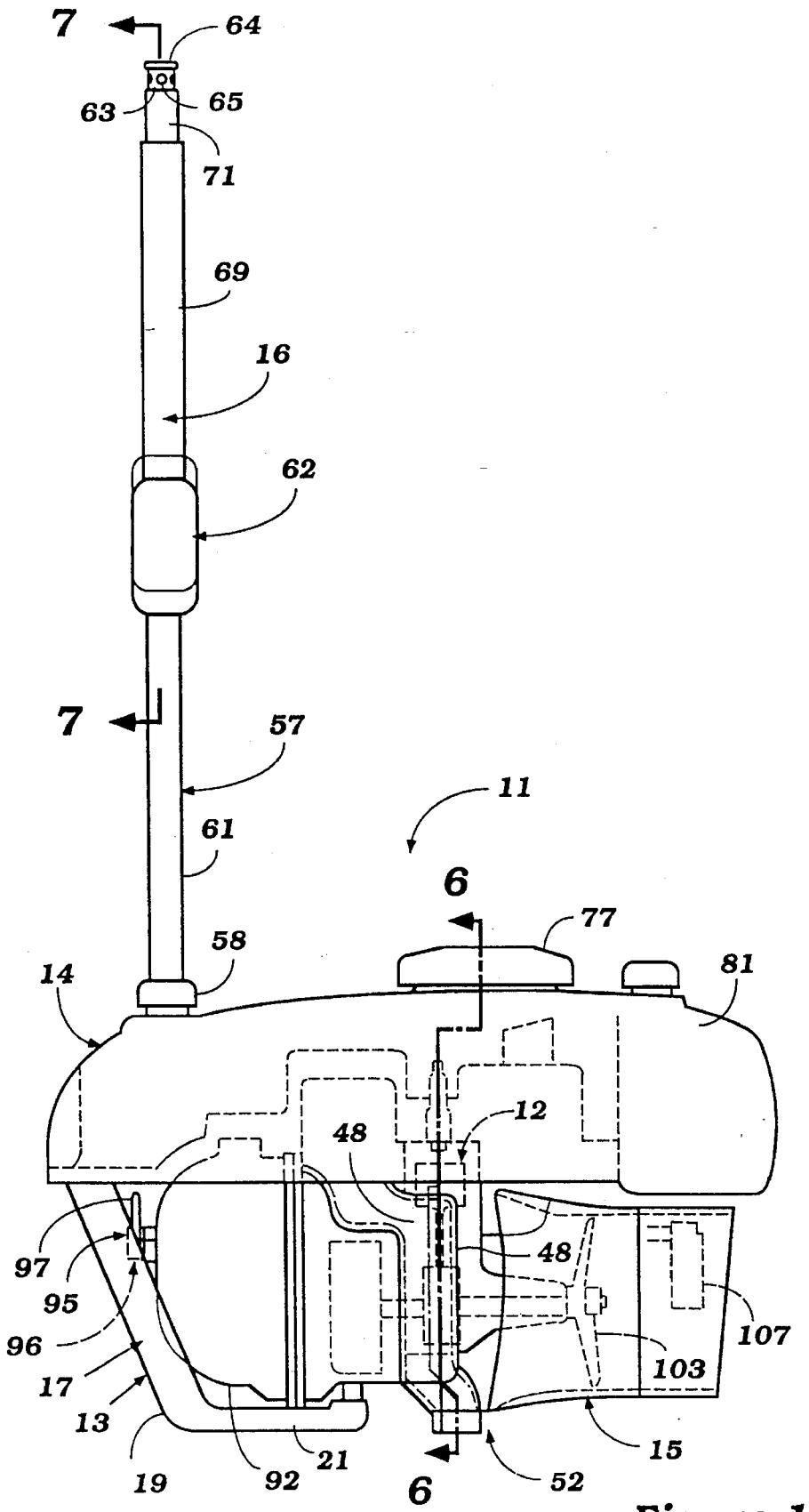
FIG. 1 is a side elevational view of a submersible power propulsion unit constructed in accordance with an embodiment of the invention.
Figure 2:
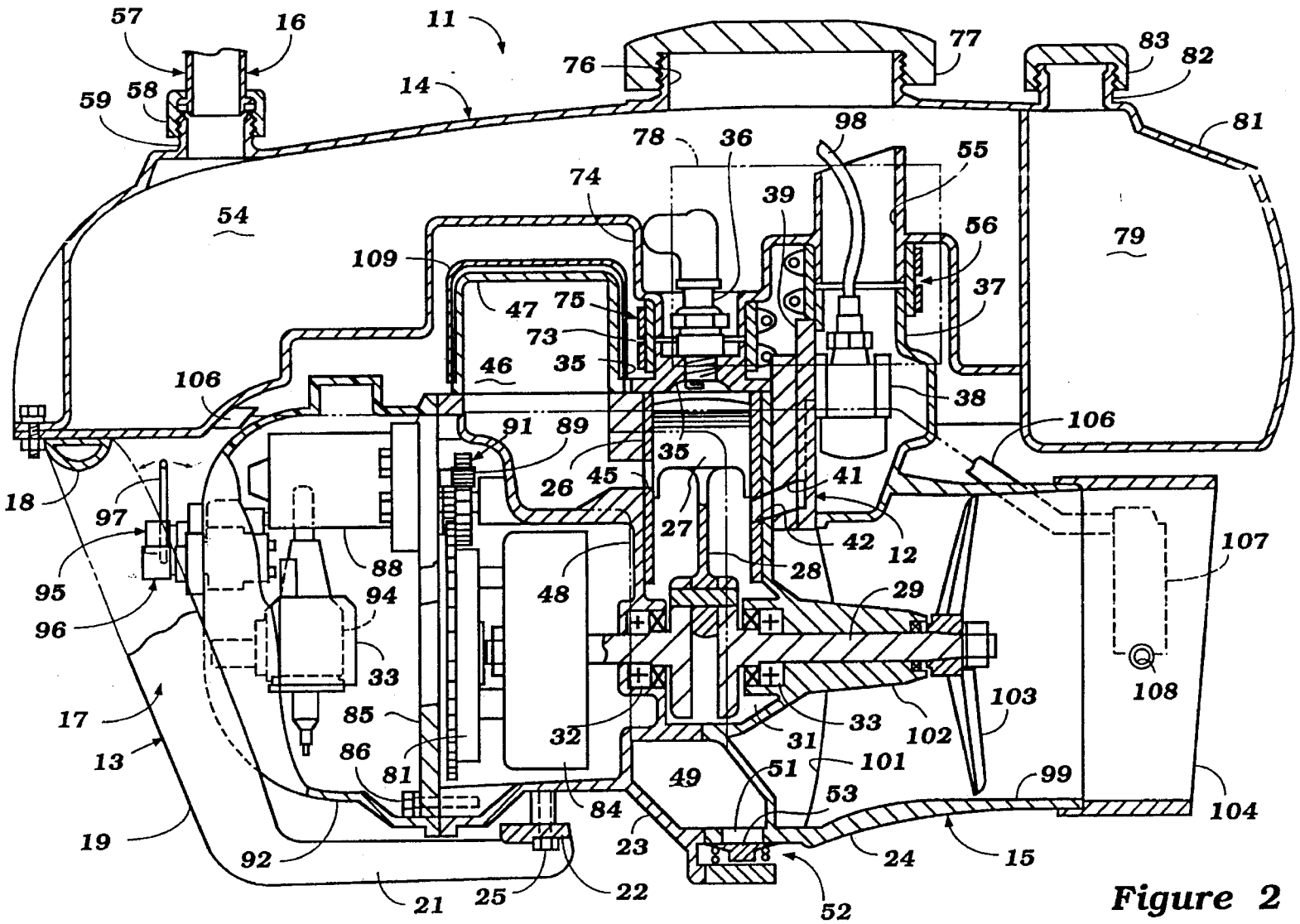
FIG. 2 is an enlarged cross-sectional view of the propulsion unit, with a portion of the air inlet device broken away.
Figure 3:
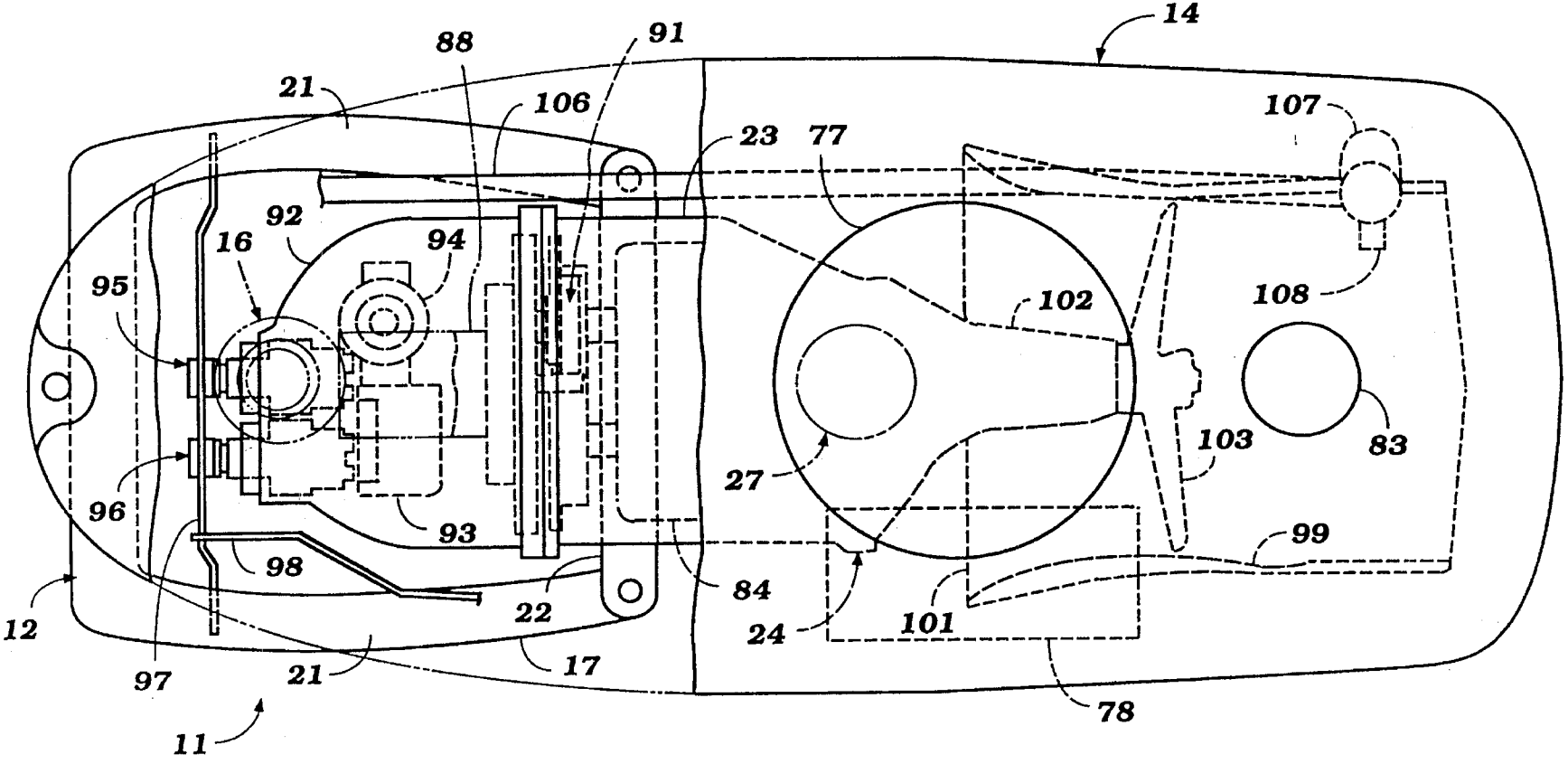
FIG. 3 is an enlarged top plan view of the propulsion device, with portions broken away to more clearly show certain components of the construction.
Figure 5:
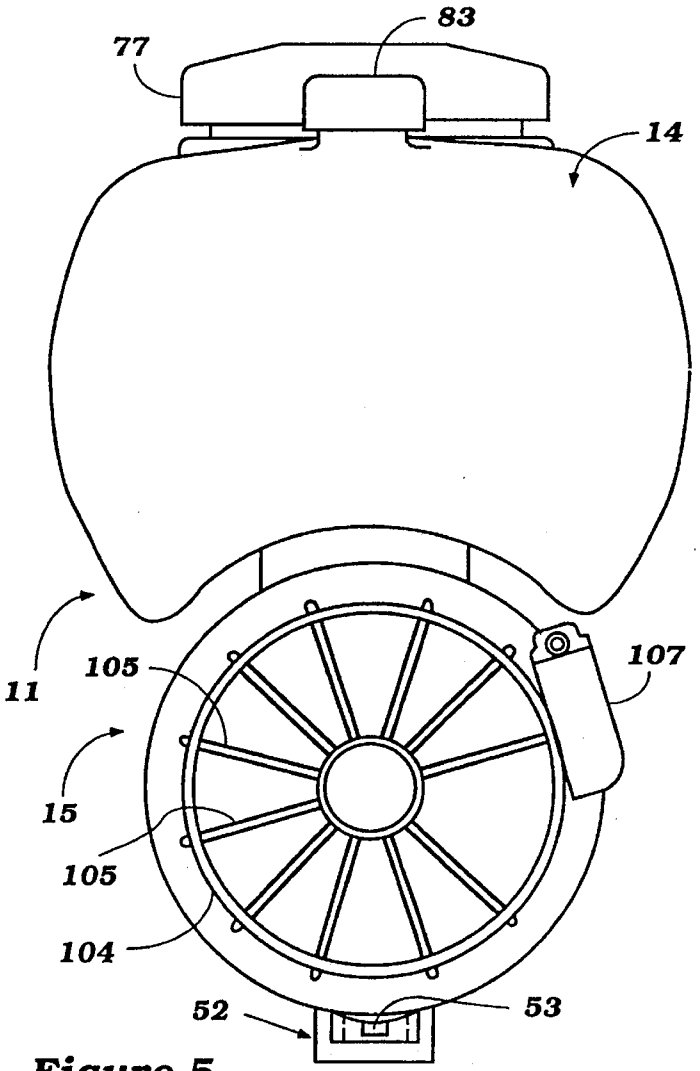
FIG. 5 is a rear elevational view of the propulsion unit.
Figure 4:
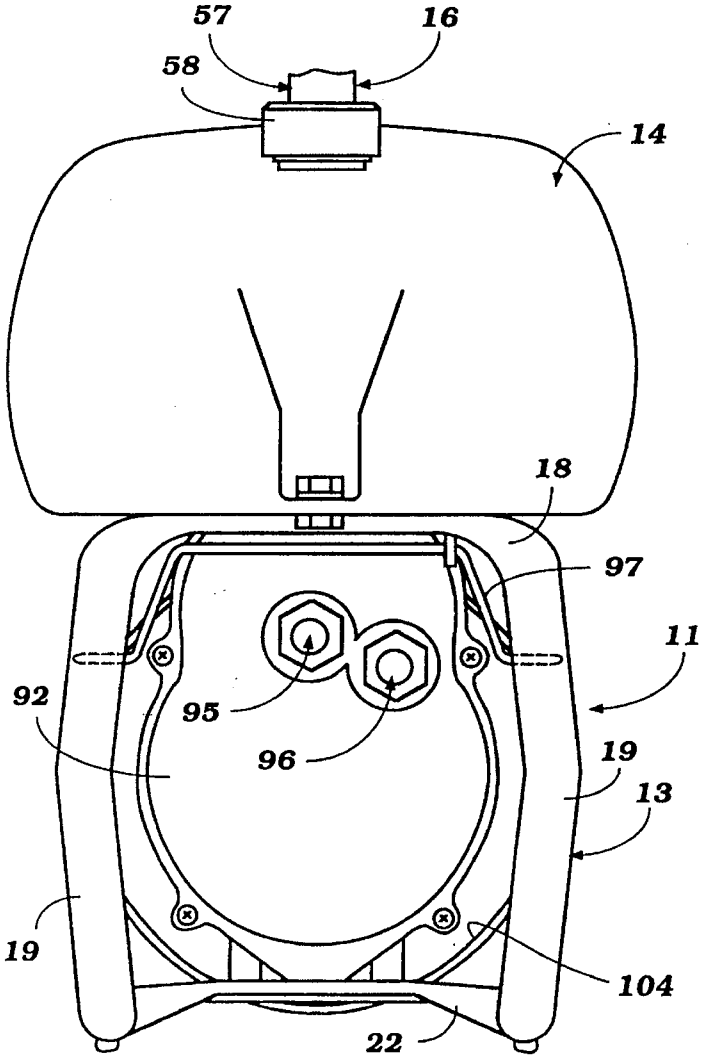
FIG. 4 is a front elevational view of the propulsion unit.

Referring now in detail to the drawings and initially primarily to FIGS. 1–3, a submersible propulsion unit constructed in accordance with an embodiment of the invention is indicated generally by the reference numeral 11. The propulsion unit 11, as will become readily apparent, is an extremely compact power unit comprised of a powering internal combustion engine, indicated generally by the reference numeral 12, which is carried by a frame assembly, indicated generally by the reference numeral 13. Disposed above the engine 12 and actually forming a part of the frame assembly, is an air tank unit, indicated generally by the reference numeral 14.

A propulsion unit, indicated generally by the reference numeral 15 is coupled, in a manner to be described, to the output shaft of the engine 12 for providing a propulsion force to a user. The user may be a snorkeler or a skin diver and employs the propulsion unit 11 to move from place to place. The propulsion unit 11 generally has sufficient buoyancy so that it will float in a body of water on its own in a partially submerged status. A snorkel-type air intake tube 16 communicates with the air tank 14 and supplies air to the engine 12 for its operation in a manner which will be described.

The frame assembly 15 appears in most detail in FIGS. 1–4 and is comprised of a tubular main frame member 17 which has a generally horizontally extending portion 18 which supports the forward end of the air tank 14 in a manner which will be described. Depending from the opposite sides of the portion 18 are a pair of generally vertically extending but rearwardly inclined side portions 19 which are disposed so that they can form handles for the rider or user to grasp when the propulsion unit 11 is employed for carrying or propelling the user through the body of water in which the propulsion unit 11 is partially submerged.

The lower ends of the side portions 19 terminate in horizontally extending sections 21 which extend rearwardly in a generally horizontal direction and which carry a horizontally extending support 22 on which the engine 12 is mounted in a manner which will be described.

Hence it will be seen that the frame member 17 and the support 22 form a generally enclosed lightweight but rigid frame for the propulsion unit 11. The remaining components of the propulsion unit 11 are connected to this frame 13 in a manner so as to provide a unitary rigid but lightweight assembly.

The engine 12 is comprised of an outer housing that consists of a forward member 23 and a rearward member 24. The forward member 23 is supported on the support 22 and affixed thereto by a plurality of threaded fasteners 25. The rearward member 24 is affixed suitably to the forward member 23 and defines with it a cylindrical opening that receives a cylinder sleeve 26. This cylinder sleeve slidably supports a piston 27 which is connected by means of a connecting rod 28 to a crankshaft 29. The crankshaft 29 is rotatably journaled within a crankcase chamber 31 formed by the housing pieces 23 and 24. The crankshaft 29 is journaled by bearing and seal assemblies 32 and 33, respectively, carried by the housing pieces 23 and 24.

A cylinder head 34 is affixed to the housing pieces 23 and 24 and closes the upper end of the cylinder bore formed by the cylinder sleeve 26 and in which the piston 27 rotates. This cylinder head 34 has a combustion chamber recess 35 into which the gap of a spark plug 36 extends. The spark plug 36 is threaded into the cylinder head 34 in a well known manner and is fired by an ignition circuit, as will be described.

The upper portion of the rear housing member 24 forms in part a carburetor enclosure 37 in which a carburetor 38 is positioned. The carburetor 38 is of the sliding piston throttle type and has a rearwardly facing air inlet opening which communicates with the interior of the carburetor enclosure 37. The forward end of this carburetor enclosure 37 is closed by a manifold plate 39 which forms an intake passage 41 that extends from the discharge side of the carburetor 38 to an intake port 42 formed in the cylinder liner 26 at an area below the piston 27 when the piston is at its top dead center position as shown in FIG. 2. As a result of this arrangement, the air and fuel which are mixed by the carburetor 38 can enter the crankcase chamber 31. Air is delivered to the carburetor 38 from the air box 14 in a manner which will be described.

The charge which enters the crankcase chamber 31 as the piston 27 moves upwardly is compressed as the piston 27 moves downwardly and eventually a pair of scavenge ports 43 (FIG. 6) will open and the charge can flow from the crankcase chamber 31 through scavenge passages 44 formed in the housing members 23 and 24 to the area above the piston 27. As the piston 27 continues its upward stroke, this charge will be further compressed in the combustion chamber formed in part by the cylinder head recess 35. The charge is then fired by the spark plug 36 in a manner which will be described and the piston 27 is driven downwardly.

Figure 6:
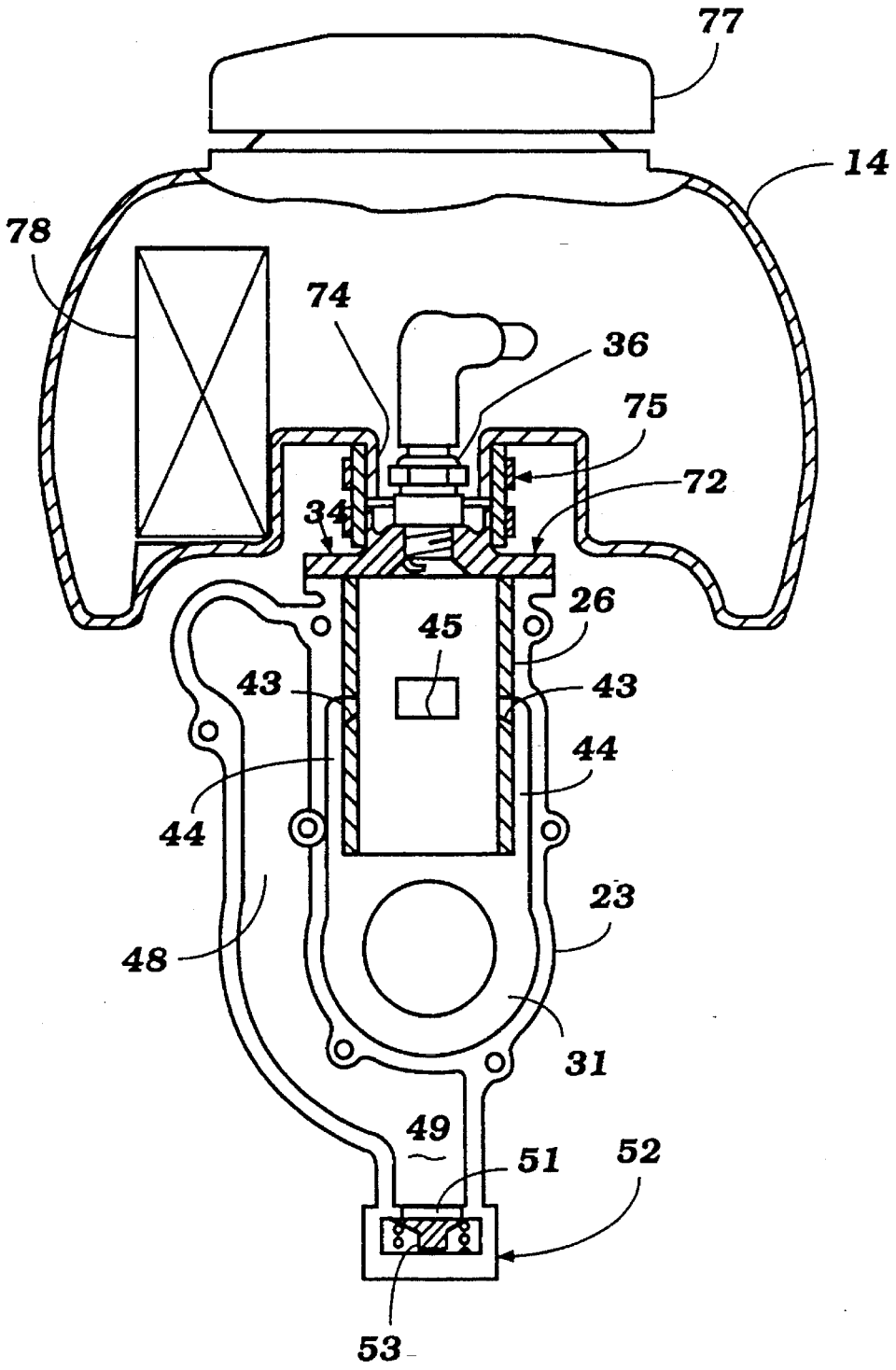
FIG. 6 is a cross-sectional view taken along the line 6—6 of FIG. 1.

Eventually, the piston 27 will move downwardly a sufficient distance so as to open an exhaust port 45 formed in the front wall of the cylinder liner 26 as best seen in FIGS. 2 and 6. The exhaust gases then enter into an exhaust manifold 46 formed in part by the front housing member 23 and by a recess 47 formed in the cylinder head 34 forwardly of the cylinder liner 26. These exhaust gases then flow through a manifold passage 48 formed at one side of the cylinder liner 26 by the housing pieces 23 and 24 to a discharge chamber 49 formed below the crankcase chamber 31.

An exhaust outlet opening 51 is formed in a lower wall of the housing piece 24 and an exhaust control valve assembly 52 that includes a spring biased! valve member 53 will open when the exhaust pressure exceeds the water pressure and the exhaust gases can exit downwardly and rearwardly from beneath the propulsion unit 11.

Referring now to the construction of the air box 14 it is best shown in FIGS. 1, 2, and 6 and is comprised of a unitary housing assembly which defines a forwardly positioned air chamber, indicated generally by the reference numeral 54. This air chamber 54 communicates with the carburetor enclosure 37 through an air flow neck 55 which extends upwardly into the air chamber 54 at a relatively high position. This flow neck 55 connected to the carburetor enclosure 37 by a hose and hose clamp assembly, indicated generally by the reference numeral 56. As a result, there is an airtight seal between the carburetor enclosure 37 and the air chamber 54 so that air may flow freely from the air chamber 54 into the induction system for the engine as thus far described.

As has been noted, the air intake device 16 functions to draw atmospheric air into the air chamber 54 and this air intake device will be described by reference to FIGS. 1, 2, and 7. The air intake device 16 includes a first tube 57 which has a screw cap 58 at its lower end that is adapted to be threaded onto a nipple 59 formed at the front of the air tank 14 so as to permit an airtight connection with the air chamber 54.

This tube 57 includes a first lower section 61 to which the cap 58 is affixed and which extends upwardly to a float assembly, indicated generally by the reference numeral 62 and which is received around a second tube section 63 that has a tight fit into the interior of the lower section 61 and thus forms an extension of the tube assembly 57. The upper end of this tube section 63 is closed by means of a closure plug 64 which is formed adjacent a plurality of air inlet openings 65 formed in the upper end of the tube 63. The float assembly 62 operates to selectively open and close the air inlet openings 65 in a manner which will be described by particular reference to FIGS. 1–7.

The float assembly 62 includes a float element 66 which is formed from a suitably buoyant material and which has a pair of annular seals 67 and 68 at its upper and lower ends. The upper seal 68 connects the float 66 to a tubular valving element 69 which, at its upper end, is connected to a smaller diameter tubular portion 71 which has a close sliding fit with the outer portion of the upper tube section 63. Thus the tubular portion 71 acts as a valve element for opening and closing the air inlet openings 65.

Figure 7:
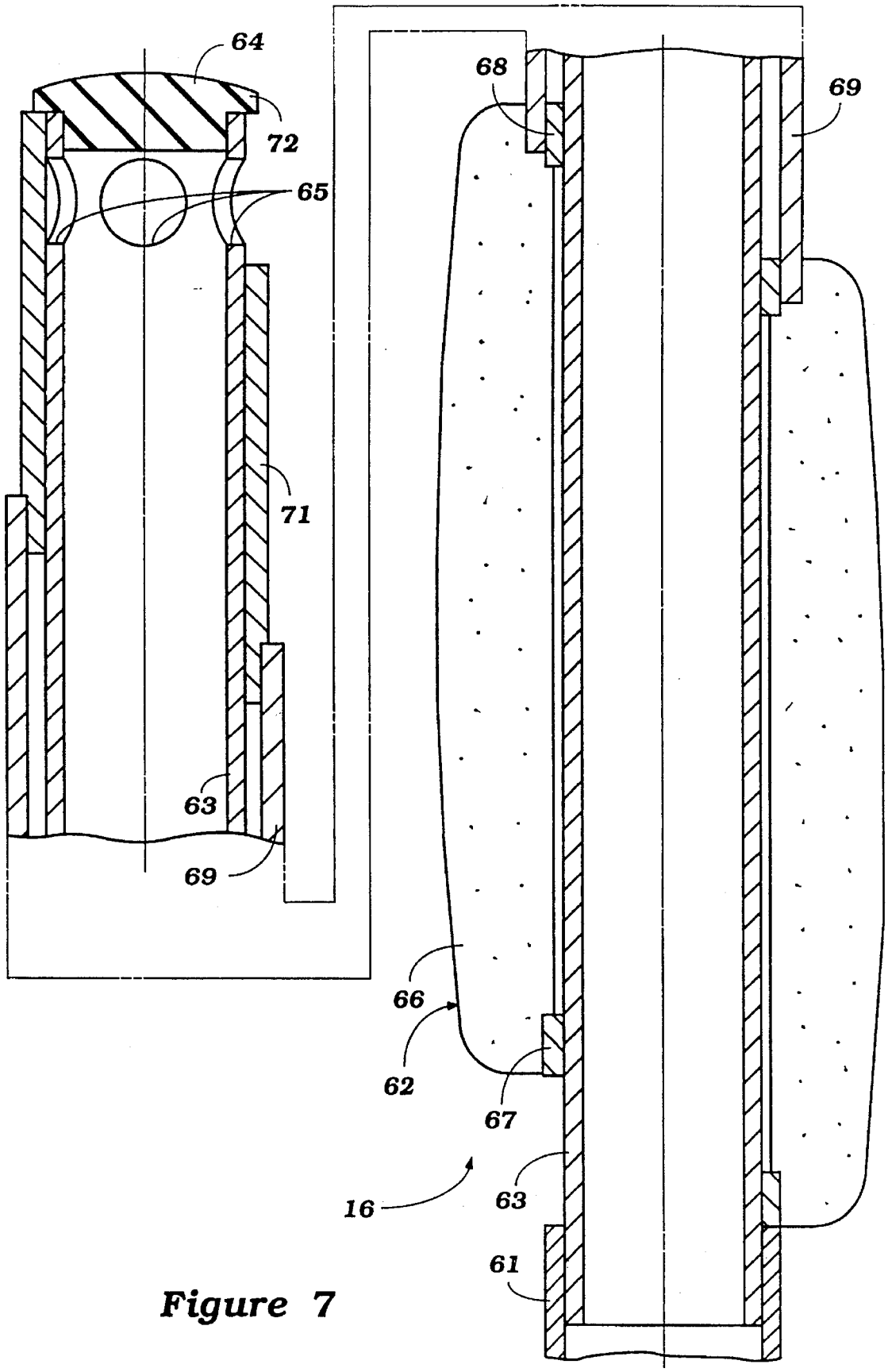
FIG. 7 is a cross sectional view taken along the line 7—7 of FIG. 1 showing the air inlet device and the depth sensitive air inlet control with the control being shown in a closed position at the left-hand side of the figure and in the fully opened position at the right-hand side of the figure.

When the propulsion unit 11 is floating in a normal attitude, the float assembly 62 moves downwardly to a position shown in solid lines in FIG. 1 and the right-hand side of FIG. 7. In this condition, the sleeve 67 carried by the float element 66 abuttingly engages the upper end of the tubular member 61 and this limits its lower position. In this position, the valving sleeve 71 clears the opening 65 so that air can easily flow into the air box 14 and specifically its air chamber 54.

If, however, the unit begins to become submerged, the float assembly 62 because of the buoyancy of the float element 66 will slide upwardly along the tube 63 until the valving tube 71 contacts a flange 72 of the closure plug 66. This will provide not only a stop but a watertight seal so that air cannot enter the snorkel tube 16 as shown in the left-hand side of FIG. 7 and in the phantom line view of FIG. 1. As soon as the degree of submersion is decreased, the snorkel valve will again open and permit air to flow to the engine 12 for its operation. The air box 54 has sufficient capacity to permit the engine to run for some period of time when the float operated valve assembly 62 is closed.

Referring again to FIG. 2, it should be noted that the area of the cylinder head 34 around the spark plug 36 is provided with a raised annular portion 73. The air box 14 also has a cylindrical section 74 that is aligned with this cylinder head portion 73 and which is sealingly connected therewith by a hose and clamp assembly, indicated generally by the reference numeral 75.

The spark plug 36 is disposed beneath an access opening 76 that is formed in the air tank 14. This access opening 76 is sufficiently large that an operator may place his hand through it and remove the spark plug 36 for servicing. A closure cap 77 normally closes the service openings 76 but permits ease of access to the spark plug for its servicing.

In addition, a battery 78 for the supplying electrical power to the engine for its starting and other functions, as will be described, is positioned in the air chamber 54 beneath the access opening 76 so that it also can be easily serviced. Hence, the spark plug 36 and battery 78 are kept in a watertight sealed environment but may be easily serviced.

The air tank 14 also forms an integral fuel tank portion 79 through a rear part 81 thereof. The fuel tank 79 has a fill opening 82 that is closed by a cap 83 so as to contain fuel to be supplied for the engine. Fuel may be supplied from the fuel tank 79 to the carburetor 38 by gravity or pumped flow through a conduit (not shown).

The electrical components and certain controls for the engine 12 will now be described by primary reference to FIGS. 1–4.

As seen in FIGS. 1 and 2, a magneto generator 84 is affixed to the forward end of the crankshaft 29 in a cavity formed at the front of the housing piece 23 and closed in part by means of a cover plate 85 affixed thereto by threaded fasteners 86. A flywheel starter gear 87 is affixed to the end of the magneto generator 85 and is adapted to be driven by a starter motor 88 mounted on the front of the cover plate 85. The starter motor 88 has a pinion gear 89 which drives the starter gear flywheel 87 through a gear train 91.

The starter motor 88 is contained within an air tight cavity formed by a cover piece 92 that is affixed to the plate 85 in sealing relationship. The flywheel magneto 84 also cooperates with a CDI ignition circuit 93 that is contained within the cover 92 and which operates a spark coil 94 for firing the spark plug 36 in a well-known manner. Although submerged, these components will be maintained in an airtight environment by the cover plate 92 and its cooperation with the other components of the housing assembly as already described.

On the forward portion of the cover plate 92 there is mounted a starter switch 95 and kill switch 96 that are readily accessible to the operator whose hands will normally be on the frame member side pieces 19 so as to start and stop the engine 12 through appropriate circuits as well known in this art.

A throttle control lever 97 is pivotally supported on the frame member 17 and is connected by means of a bowden wire actuator 98 to the sliding piston throttle of the carburetor 38. This bowden wire actuator 98 extends in part through the air box 14 and through the carburetor air flow opening 55. This wire actuator can be easily sealed at the point where it passes through the air box chamber 54 in manners well known in the art.

The propulsion device 15 will now be described. It is of the ducted propeller or jet propulsion type. This is comprised of a ducted housing portion 99 formed by the housing piece 24 at the rear end of a water inlet opening 101. The housing piece 24 has a tubular section 102 extending into the ducted area 99 and through which the crankshaft 29 extends. A propeller or impeller 103 is affixed to the exposed end of the crankshaft 29 and is driven at full engine speed so as to draw water through the inlet opening 101 and discharge it through the duct 99 rearwardly to provide the propulsion force for the unit 11.

A further discharge nozzle section 104 may be slipped back over the rear end of the flow portion 99 and is provided with a plurality of vanes 105 it will prevent the operator from placing his hand into the duct 99 where it could be injured by a propeller 103.

A drain system is provided for draining any water which might accumulate in the air chamber 54 and this includes a drain pipe 106 (FIGS. 2 and 3) that is disposed at the front portion of the air chamber 54 and at an area where it is the lowest. This drain tube 106 is disposed at a substantial distance from the carburetor air supply duct 55 so as to ensure that water cannot reach this rearward area. The drain tube 106 communicates with a check valve assembly 107 formed between the conduit 106 and a discharge opening 108 that extends into the nozzle section 104. A venturi action will cause a negative pressure at the opening 108 to draw water from the air chamber 54 when the impeller 103 is moving water to propel the vehicle. When the vehicle becomes stationary or slows down, the check valve 107 will close so as to ensure that water cannot flow back into the air chamber 54.

Finally, there is provided a heat insulating cover 109 that is slid over the cylinder head exhaust manifold portion 47 (FIG. 2) so as to ensure that the heat from the exhaust will not be transmitted to the air chamber 54. Aside from this and since the propulsion unit 11 is primarily submerged, the body of water in which the unit 11 is operating will provide adequate cooling for the engine 12 and other components which generate heat. However, there is an appropriate degree of insulation provided by the housing assembly that the engine operating temperature will not be too low.

It should be readily apparent that the described propulsion unit provides a very compact propulsion unit that can be operated in a submerged or semi-submerged state and ensures that water cannot enter the engine through its induction system. In addition, the air tank for the induction system is configured so that it can be accessed to service components such as the battery or spark plug. Various other components requiring-servicing can be placed in this air chamber. Of course, the foregoing description is that of a preferred embodiment of the invention and various changes and modifications may be made without departing from the spirit and scope of the invention, as defined by the appended claims.

We claim:

1. A personal submersible propulsion unit comprised of a frame assembly, an internal combustion engine having an induction system carried by said frame assembly for a least partial submersion in a body of water, a propulsion device carried by said frame assembly and drive by said engine for propelling said frame assembly through a body of water, said induction system including an air inlet device for extending above the level of water in which said propulsion unit is operated, an air box supplied with air from said air inlet device, means responsive to the level of submersion of said propulsion unit for controlling said inlet device, said air box supplying air to said engine induction system, a battery sealed within said air box, and an access opening in said air box through which said battery may be accessed.

2. The personal submersible propulsion unit as set forth in claim 1, wherein the engine induction system comprises a carburetor and wherein the air box has a tubular section connected in sealing relationship to said carburetor.

3. The personal submersible propulsion unit as set forth in claim 1 wherein said engine is spark ignited and the spark plug is sealed within the air box in proximity to the access opening.

4. The personal submersible propulsion unit as set forth in claim 1, wherein the air box further forms an integral fuel tank for the engine.

5. A personal submersible propulsion unit for use in propelling a swimmer holding onto and controlling said unit which is in the same body of water as said unit, said unit being comprised of a frame assembly, a spark-ignited internal combustion engine having an induction system carried by said frame assembly for at least partial submersion in a body of water while still operating, a propulsion device carried by said frame assembly and driven by said engine for propelling said frame assembly and the associated swimmer through a body of water, an air box carried by said frame assembly above said engine, means for communicating the interior of said air box with said engine induction system for supplying air to said engine induction system from said air box, an access opening formed in an upper surface of said air box and closed by a removable closure, and a spark plug for said engine sealed within said air box in proximity to and removable and accessible through said access opening.

6. The personal submersible propulsion unit comprised of a frame assembly, an internal combustion engine having an induction system carried by said frame assembly for at least partial submersion in a body of water, a propulsion device carried by said frame assembly and driven by said engine for propelling said frame assembly through a body of water, an air box carried by said frame assembly above said engine, means for communicating the interior of said air box with said engine induction system for supplying air to said engine induction system from said air box, an access opening formed in an upper surface of said air box and closed by a removable closure, and a battery contained within said air box and removable and accessible through said access opening.

7. The personal submersible propulsion unit as set forth in claim 6, wherein the air box further forms an integral fuel tank for the engine.

* * * * *